US008080354B2

(12) United States Patent
Kozuru et al.

(10) Patent No.: US 8,080,354 B2
(45) Date of Patent: Dec. 20, 2011

(54) TONER

(75) Inventors: Hiroyuki Kozuru, Yamanashi (JP); Yoshiyasu Matsumoto, Tokyo (JP); Kosuke Nakamura, Tokyo (JP); Futoshi Kadonome, Tokyo (JP); Takanari Kayamori, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 241 days.

(21) Appl. No.: 12/631,965

(22) Filed: Dec. 7, 2009

(65) Prior Publication Data

US 2010/0151378 A1 Jun. 17, 2010

(30) Foreign Application Priority Data

Dec. 12, 2008 (JP) ..... 2008-316634

(51) Int. Cl.
*G03G 9/00* (2006.01)

(52) U.S. Cl. ..... 430/110.4

(58) Field of Classification Search ..... 430/110.4
See application file for complete search history.

(56) References Cited

FOREIGN PATENT DOCUMENTS

| | | |
|---|---|---|
| JP | 5188643 | 7/1993 |
| JP | 8254873 | 10/1996 |
| JP | 2000267536 | 9/2000 |

*Primary Examiner* — Mark Chapman
(74) *Attorney, Agent, or Firm* — Lucas & Mercanti, LLP

(57) ABSTRACT

Disclosed is toner in which is used in an image formation process comprising the steps of transferring an image of toner formed on a photoreceptor onto a recording sheet, and removing any residual toner remaining on any of the photoreceptor, an intermediate transfer member and a secondary transfer member with a cleaning blade, the toner containing at least toner particles (A) and small particles (B), wherein the toner particles (A) have an average circularity of from 0.93 to 0.99 and a number-based median diameter ($D_{50}$) of from 3.0 to 8.0 μm, the small particles (B) have an average circularity of from 0.70 to 0.92 and a number-based median diameter ($D_{50}$) of from 0.15 to 0.60 times that of the toner particles (A), and the surface energy of the toner particles (A) is different from that of the small particles (B).

6 Claims, 6 Drawing Sheets

TONER

This application is based on Japanese Patent Application No. 2008-316634, filed on Dec. 12, 2008 in Japanese Patent Office, the entire content of which is hereby incorporated by reference.

FIELD OF THE INVENTION

The present invention relates to toner used in an electrophotographic image formation process.

TECHNICAL BACKGROUND

There is a great demand for a method for obtaining an image with high quality employing an electrophotographic image formation process.

As a method for obtaining an image with high quality, an attempt is carried out which employing toner with a small particle size.

Toner with a small particle size may lower the fluidity and cause such image defects that a part of an image pattern lacks. Therefore, in order to improve fluidity of the toner with a small particle size, a method for smoothing the toner surface and sphering the toner is carried out.

Generally, it is necessary in an electrophotographic image formation process that when a toner image is transferred from the image carrier to a recording sheet, toner remaining on the image carrier without being transferred to the recording sheet must be removed from the image carrier. As a method to remove any residual toner remaining on the image carrier, there is one in which the end of a cleaning blade made of an elastic material such as urethane is brought into contact with the image carrier. In this method, one end of the cleaning blade is generally arranged to press against the image carrier in a direction counter to the direction of movement of the image carrier.

It is known that when the cleaning blade as described above is employed, a spherical toner with a small particle size slips through the cleaning blade end, resulting in extremely difficult cleaning.

Various explanations have been made hitherto regarding the phenomenon that the spherical toner slips through the cleaning blade end. The general explanation is as follows. The spherical toners having a large area contacting each other and the same particle size, which are collected in the edge portion (nip portion) of the cleaning blade, are difficult to move over each other, and tend to form a closed-packed structure (structure packed without voids). Such spherical toners further have a large area contacting the surface of an image carrier and strong adhesion, and have a force lifting the edge of the cleaning blade as one aggregate. As a result, the spherical toners slip through the cleaning blade end. Simple increase of the contact pressure of the cleaning blade, which is small in the cleaning effect and rather shortens lifetime of the image carrier, is not applied in many cases.

A method has been studied which eliminates toner remaining on the image carrier surface through a cleaning blade, even when the spherical toner above is employed.

Typical methods are as follows.

(A) A method which supplies to the surface of an image carrier a lubricant reducing a coefficient of friction of the image carrier surface.

The method is disclosed in which even if the spherical toner forms a close-packed structure, slipping property of an image carrier surface is increased by reduction of the coefficient of friction of the image carrier surface, which provides the effect that the toner does not slip through the cleaning blade (see for example, Japanese Patent O.P.I. Publication No. 5-188643).

(B) A method in which an irregular-shaped toner prepared according to a pulverizing method is incorporated as a developer in one developing tank containing one color toner in a four-color full color image formation apparatus.

The method is disclosed in which spherical toner is mixed with the irregular-shaped toner at the vicinity of a nip portion, and does not form a close-packed structure, thereby preventing the toner from slipping through the cleaning blade (see for example, Japanese Patent O.P.I. Publication No. 8-254873).

(C) A method which prevents toner from slipping through the cleaning blade employing a mixed powder material of lubricant particulate coated on the end of the cleaning blade and irregular-shaped toner having an average particle size smaller than spherical toner The method is disclosed in for example, Japanese Patent O.P.I. Publication No. 2000-267536.

Study on the above (A), (B) and (C) has been made, and the results are as follows.

(Problem of Item (A) Above)

The item (A) above has problem in that most of a lubricant proposed as reducing the coefficient of friction of the image carrier surface are likely to absorb moisture under high temperature and high humidity, and the lubricant adhered onto the image carrier surface has an adverse effect on the charging state, resulting in image faults such that an image lacks.

(Problem of Item (B) Above)

The item (B) can be applied to an image carrier bearing an image with plural colors, but not to an image carrier in a tandem color image formation apparatus. The item (B) above has problem in that since at the beginning of image formation, a sufficient amount of irregular-shaped toner does not reach the end of the cleaning blade, a large amount of spherical toners reaching there slip through the cleaning blade according to the mechanism described above.

(Problem of Item (C) Above)

In the item (C) above, a barrier is formed from the irregular-shaped toner. Since the toner forming the barrier and toner to be dammed by the barrier are of the same kind, it is difficult that only the irregular-shaped selectively reaches the end of the cleaning blade. Therefore, the item (C) has problem in that an efficient barrier as described above cannot be formed, and the spherical toner slips through the cleaning blade.

As is described above, a method has not been found yet which effectively cleans residual toner remaining an the image carrier surface after transfer employing a cleaning blade.

In an image formation method forming a patch image, cleaning of toner (hereinafter also referred to as a patch image toner) forming a patch image is a burden, since the amount of toner to be cleaned in the patch image is more than that of residual toners after transfer.

The patch image refers to one which is employed to correct so as to maintain the normal image density. Typically, a 1.5 cm square patch image of each color is formed on a photoreceptor, and transferred to an intermediate transfer member, wherein a reflection density of each color patch image transferred to the intermediate transfer member is measured employing a detect sensor, thereby controlling so as to obtain a normal image density. When the patch image density is low, charging condition or development condition is controlled to increase the density, and when the patch image density is high, charging condition or development condition is controlled to decrease the density, whereby a print image with good quality is obtained.

SUMMARY OF THE INVENTION

An object of the invention is to provide a toner which provides excellent cleaning property of residual toner remaining after transfer or a patch image toner and forms continuously a print image with high density, high quality and no fog.

The toner of the invention contains at least toner particles (A) and small particles (B), wherein the toner particles (A) have an average circularity of from 0.93 to 0.99 and a number-based median diameter ($D_{50}$) of from 3.0 to 8.0 μm, the small particles (B) have an average circularity of from 0.70 to 0.92, and a number-based median diameter ($D_{50}$) of from 0.15 to 0.60 times that of the toner particles (A), and the surface energy of the toner particles (A) is different from that of the small particles (B), and wherein the toner is used in an image formation process comprising the steps of transferring a toner image formed on a photoreceptor on a recording sheet, and removing any toner remaining on any of the photoreceptor, an intermediate transfer member and a secondary transfer member with a cleaning blade.

DETAILED DESCRIPTION OF THE INVENTION

Figure 1:
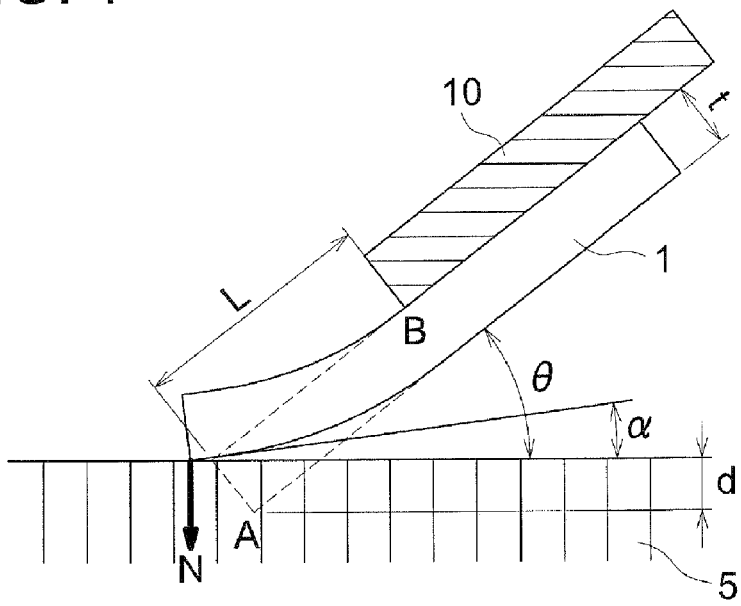
FIG. 1 is a schematic view showing main parameters of a cleaning blade.

The present invention can be attained by any of the following constitutions.

1. Toner, which is used in an image formation process comprising the steps of transferring an image of toner formed on a photoreceptor onto a recording sheet, and removing any residual toner remaining on any of the photoreceptor, an intermediate transfer member and a secondary transfer member with a cleaning blade, the toner containing at least toner particles (A) and small particles (B), wherein the toner particles (A) have an average circularity of from 0.93 to 0.99 and a number-based median diameter ($D_{50}$) of from 3.0 to 8.0 μm, the small particles (B) have an average circularity of from 0.70 to 0.92 and a number-based median diameter ($D_{50}$) of from 0.15 to 0.60 times that of the toner particles (A), and the surface energy of the toner particles (A) is different from that of the small particles (B).

2. The toner of item 1 above, wherein the content of the small particles (B) is 0.2 to 20 parts by weight, based on 100 parts by weight of the toner particles (A).

3. The toner of item 1 or 2 above, wherein the difference between the surface energy of the toner particles (A) and that of the small particles (B) is not less than $3\times10^{-3}$ N/m or more.

4. The toner of any of claims 1 through 3, wherein the surface energy of the toner particles (A) is greater than that of the small particles (B).

The toner of the invention has advantageous effect that it provides excellent cleaning property in residual toner remaining after transfer or a patch image toner and forms continuously a print image with high density, high quality and no fog.

The present inventors have made an extensive study in order to solve the problem that causes cleaning fault of spherical toners' slipping through the cleaning blade end.

The present inventors have considered that a barrier of specific toners, which is formed on the end (nip portion) of the cleaning blade, prevents close-packed spherical toner groups from slipping through the cleaning blade end, and made an extensive study.

As a result, the present inventors have found that a barrier of small particles (B), which is formed at the end of the cleaning blade, can prevent occurrence of cleaning fault that toner particles (A) slip through the cleaning blade end.

The small particles (B), when they reach a nip portion of a cleaning blade together with spherical toners, have properties (1) and (2) below.

(1) The small particles (B) are more likely to reach the nip portion.

(2) The small particles (B) remain at the nip portion without slipping through the portion and form a barrier there.

In order to satisfy the property (1) above, it is necessary that the number-based median diameter ($D_{50}$) of the small particles (B) be smaller than that of the toner particles (A) and the surface energy of the small particles (B) is different from that of the toner particles (A).

When the surface energy of the small particles (B) is the same as that of the toner particles (A), the small particles (B) are difficult to separate from the toner particles (A), and therefore, a barrier composed only of the small particles (B) is difficult to form.

In order to satisfy the property (2) above, it is necessary that the small particles (B) are non-spherical. When the small particles (B) are non-spherical, they can form a barrier at the nip portion without slipping through the nip portion.

The toner of the invention has the following characteristics.

(1) The toner contains at least toner particles (A) and small particles (B).

(2) The toner particles (A) have an average circularity of from 0.93 to 0.99 and a number-based median diameter ($D_{50}$) of from 3.0 to 8.0 μm.

(3) The small particles (B) have an average circularity of from 0.70 to 0.92, and a number-based median diameter ($D_{50}$) of the small particles (B) is from 0.15 to 0.60 times that of the toner particles (A).

(4) The surface energy of the toner particles (A) is different from that of the small particles (B).

It is preferred in the toner of the invention that the content of the small particles (B) is 0.2 to 20 parts by weight, based on 100 parts by weight of the toner particles (A).

It is preferred in the toner of the invention that the difference between the surface energy of the toner particles (A) and that of the small particles (B) is not less than $3\times10^{-3}$ N/m.

FIG. 1 is a schematic view showing main parameters of a cleaning blade.

In FIG. 1, L represents a free length of the cleaning blade, t represents a thickness of the cleaning blade, α represents a touching angle of the cleaning blade to a transfer member, θ represents a prescribed angle, d represents a press-in depth, N represents a touching pressure, numerical number 5 represents a member to be cleaned, numerical number 10 represents a blade holder, B represents an end of the blade holder 10, A represents an end point of the cleaning blade. The free length L of the cleaning blade represents a distance between the end B of the cleaning blade and the end point A (illustrated by a broken line) of the cleaning blade assumed not to be deformed.

Figure 2:
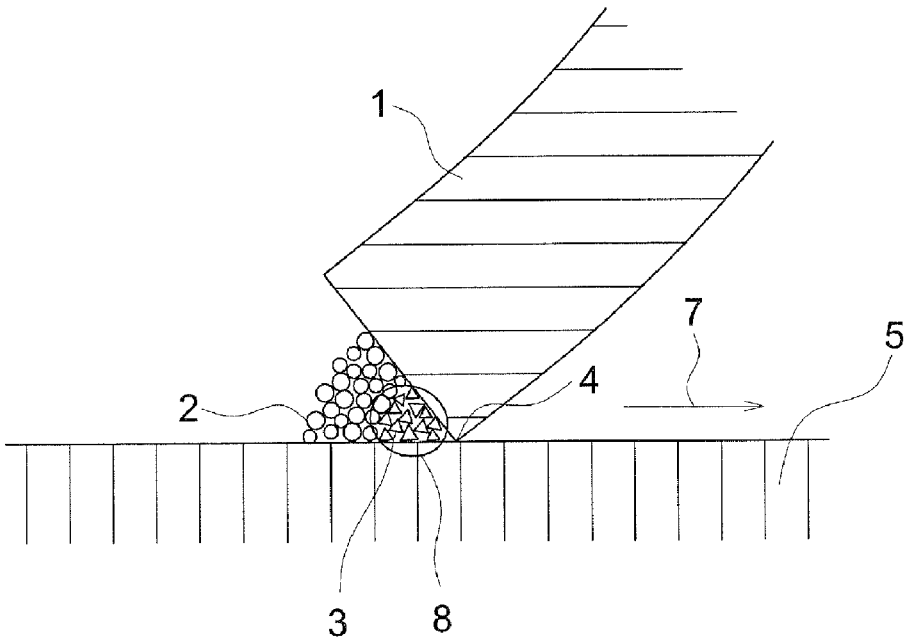
FIG. 2 is a schematic view showing such a state that small particles (B) form a barrier at a nip portion of the cleaning blade and the toner particles (A) are stopped there by the barrier.

FIG. 2 is a schematic view showing such a state that small particles (B) form a barrier at a nip portion of the cleaning blade and the toner particles (A) are dammed by the barrier.

In FIG. 2, numerical number 1 represents a cleaning blade, numerical number 2 represents toner particles (A), numerical number 3 represents small particles (B), numerical number 4 represents a nip portion, numerical number 5 represents a member to be cleaned (a photoreceptor, an intermediate transfer member, a secondary transfer member), T represents a moving direction of the member to be cleaned, and numerical number 8 represents a barrier.

Next, the invention will be explained in detail.

Firstly, the constitution defined in the invention will be explained.

<Average Circularity of Toner Particles (A) and Small Particles (B)<

The average circularity of the toner particles (A) constituting the toner of the invention is from 0.93 to 0.99, and preferably from 0.935 to 0.985. When the average circularity falls within the above range, the toner is provided with appropriate fluidity, and is difficult to damage and deteriorate, even when mechanical load is continuously applied to the toner in an image formation apparatus for a long time. That is, the toner is provided with high durability, and print images with high precision can be stably formed for a long term.

The average circularity of the small particles (B) constituting the toner of the invention is from 0.72 to 0.92, and preferably from 0.73 to 0.901. When the average circularity of the small particles (B) falls within the above range, the small particles (B) can form a barrier without slipping through the nip portion.

The circularity of the toner particles (A) is a value calculated from the following equation:

Circularity of toner particles (*A*)=(circumference of a circle having the same area as a projected particle image of toner particles (*A*))/(circumference length of a projected particle image of toner particles (*A*))

The average circularity of the toner particles (A) can be determined using a flow particle image analyzer "FPIA-2100" (produced by Sysmex Corp.).

Specifically, a toner is wetted with an aqueous solution containing a surfactant to separate toner particles (A) from small particles (B), the separated toner particles (A) were dispersed via ultrasonic dispersion treatment for 1 minute, and measurement was carried out through FPIA-2100 under the measurement condition HPF (high magnification photographing) mode at an appropriate density of an HPF detection number of 2,000 to 4,000 which is the range providing reproducible measurements.

The circularity of the small particles (B) can be calculated in the same manner as the toner particles (A) above.

<Number-Based Median Diameter ($D_{50}$) of Toner Particles (A) and Small Particles (B)>

The toner particles (A) having a number-based median diameter ($D_{50}$) of from 3.0 to 8.0 μm can stably form a print image with high precision for a long time.

When the number-based median diameter ($D_{50}$) of the small particles (B) is from 0.15 to 0.60 times that of the toner particles (A), it can form a barrier at a nip portion.

The number-based median diameter ($D_{50}$) of the toner particles (A) and the small particles (B) can be determined using Multisizer 3 (produced by Beckmann Coulter Co.), connected to a computer system for data processing.

Measurement of a number-based median diameter ($D_{50}$) using Multisizer 3 is carried out according to the following procedures:

(1) The toner is wetted in a surfactant-containing aqueous solution to divide into the toner particles (A) and the small particles (B). Thus, specimens of the toner particles (A) and the small particles (B) are prepared.

(2) Each specimen of 0.02 g are sufficiently wetted in 20 ml of a surfactant-containing solution and subjected to ultrasonic dispersion to prepare a dispersion specimen.

(3) Using a pipette, the dispersion specimen is poured into a beaker having ISOTON II (produced by Beckman Coulter Co.) within a sample stand, until reaching a measurement concentration of 5 to 10%.

(4) The measurement count was set to 2,500 to perform measurement. The aperture diameter of Multisizer 3 is 20 μm.

<Surface Energy of Toner Particles (A) and Small Particles (B)>

The invention is characterized in that there is a difference between the surface energy of the toner particles (A) and that of the small particles. Such a difference can prevent the toner particles (A) from mixing with small particles (B) and form a barrier of the small particles (B).

The absolute value of the difference between the surface energy of the toner particles (A) and that of the small particles (B) is preferably not less than $3\times10^{-3}$ N/m, and more preferably from $3\times10^{-3}$ N/m to $4\times10^{-2}$ N/m. It is preferred that the surface energy of the toner particles (A) is greater than that of the small particles (B).

The surface energy of the toner particles (A) or the small particles (B) can be determined by measuring an angle of contact of a plate obtained by applying heat to each of the particles.

A method will be explained below in which a surface energy is determined from the angle of contact obtained by measurement of a plate prepared by heat fusion of each particle.

Measurement of Angle of Contact

The angle of contact of a plate prepared by heat fusion of each of the particles is obtained by measuring the angle of contact with respect to pure water using an automatic contact angle meter (special roll type CA-W model, produced by Kyowa Interface Science Co., Ltd.) at 23° C. and 50% RH. In order to achieve a good balance between measurement stability and change of measured values depending on evaporation of water, measurement is to be terminated within 5 to 30 seconds after water droplets are dropped on the plate. Angle of contact θ is measured via a θ/2 method. Angles of contact are measured at 12 positions on the plate, and the average thereof is defined as contact of angle in the invention.

The surface energy is calculated from the angle of contact obtained above according to an expanded Fowkes theory (see Handling Specification of Surface Free Energy Analyzing Software EG-11 manufactured by Kyowa Interface Science Co., Ltd.).

Next, preparation of the toner particles (A) and the small particles (B) will be explained.

<Preparation of Toner Particles (A)>

The toner particles (A) in the invention are particles containing at least a resin and a colorant. A preparation method of the toner particles (A) is not specifically limited and a conventional toner preparation method is used. For example, there are a so-called pulverizing toner preparation method (pulverizing method) in which the toner particles (A) are prepared through kneading, pulverizing and classifying, and a so-called polymerization toner preparation method (such as an emulsion polymerization method, a suspension polymerization method and a polyester elongation method) in which a polymerizable monomer is subjected to polymerization and at the same time the particles are formed controlling the shape or size.

Of these, preparation of toner according to the polymerization method is preferred, since it is possible to form the intended toner particles (A) while controlling the shape or size during the preparation process.

Of the polymerization methods, an emulsion coagulation method is one effective preparation method, in which resin particles with a size of about 120 nm are prepared in advance according to the emulsion polymerization method or the suspension polymerization method, and then coagulated, thereby forming particles.

Next, a preparation example of the toner particles (A) according to the emulsion coagulation method will be explained. In the emulsion coagulation method, the toner particles (A) are generally prepared according to the following procedures.

(1) Preparation Step of Resin Particle Dispersion Solution
(2) Preparation Step of Colorant Particle Dispersion Solution
(3) Coagulation/Fusion Step of Resin Particles
(4) Ripening Step
(5) Cooling Step
(6) Washing step
(7) Drying Step
(8) External Additive Treatment Step (Optionally)

Next, each step will be explained.

(1) Preparation Step of Resin Particle Dispersion Solution

This step is one in which a polymerizable monomer constituting resin particles is incorporated in an aqueous medium and polymerized, thereby forming a resin particle dispersion solution containing resin particles with a size of about 120 nm. Resin particles containing wax can be formed, wherein wax is dissolved or dispersed in a polymerizable monomer and the resulting solution or dispersion is polymerized in an aqueous medium, thereby forming resin particles containing wax.

(2) Preparation Step of Colorant Particle Dispersion Solution

This step is one in which a colorant is dispersed in an aqueous medium, thereby forming a colorant particle dispersion solution containing colorant particles with a size of about 110 nm.

(3) Coagulation/Fusion Step of Resin Particles

This step is one in which resin particles and colorant particles are coagulated and fused in an aqueous medium to form particles. In this step, a coagulant such as alkaline metal salts or alkaline earth metal salts are added at a concentration exceeding the critical aggregation concentration to an aqueous medium in which resin particles and colorant particles are present, and heated to at least the glass transition temperature of the resin particles and also to at least melt peak temperature (° C.) of a mixture of the resin particles and colorant particles, whereby coagulation and fusion are simultaneously carried out. Specifically, the resin particles and the colorant particles obtained above are added to a reaction system and added with a coagulant such as magnesium chloride, whereby coagulation and fusion are simultaneously carried out to form particles. When the intended particle size is reached, the coagulation is allowed to terminate by addition of a salt such as a sodium chloride solution.

(4) Ripening Step

This step is one in which after the coagulation and fusion step, the reaction system is ripened by heat-treatment until the particles reach an intended circularity.

(5) Cooling Step:

This step is one in which the above particle dispersion solution is cooled. Cooling is carried out at a cooling rate of from 1 to 20° C./minute. The cooling method is not specifically limited, and there are, for example, a method in which cooling is carried out via introduction of a cooling medium from the exterior of the reaction vessel and a method in which cooling is carried out via direct charging of cooled water into the reaction system.

(6) Washing Step

This step comprises a step in which the particle dispersion solution cooled to a predetermined temperature is subjected to solid/liquid separation to obtain the wet aggregate cake and a step in which materials such as a surfactant and a coagulant, adhering to the cake, are removed from the cake.

Washing is conducted until the filtrate reaches a conductivity of 10 μS/cm. Filtration methods include a centrifugal separation method, a vacuum filtration method which is carried out employing a Buchner funnel and a filtration method which is carried out employing a filter press, but the filtration methods are not specifically limited.

(7) Drying Step

This step is one in which the washed particles are dried to obtain dry particles. Driers employed in this step include a spray drier, a vacuum-freeze drier and a reduced-pressure drier, a static tray drier, a portable type tray drier, a fluidized-bed drier, a rotary drier and an agitation type drier.

The moisture content in the dried particles is preferably at most 5% by weight, and more preferably at most 2% by weight. Meanwhile, when the dried particles are aggregated via a weak mutual attraction force, the aggregates may be pulverized. As the pulverizing device, a mechanically pulverizing apparatus such as a jet mill, a Henschel mixer, a coffee mill or a food processor is employed.

(8) External Additive Treatment Step

This step is one in which the dried particles are mixed with external additives to prepare the toner particles (A). As a mixing device, there are usable mechanically mixing apparatus such as a Henschel mixer and a coffee mill.

The toner particles (A) in the invention may be one which is obtained by heat-treating particles prepared according to a pulverizing method, the circularity of the particles controlled by the heat treatment. Specifically, the particles can be prepared according to the following procedures.

In preparation of toner according to the pulverizing method, components of toner such as a binder resin, a charge regulating agent and a colorant are mixed in a Henschel mixer and the resulting mixture is incorporated into a kneader such as a biaxially extrusion kneader and kneaded.

The resulting kneading mixture is cooled, roughly pulverized in a feather mill or a hammer mill, and finely pulverized in a mechanical pulverizing apparatus such as kryptron or an aerially pulverizing apparatus such as a jet mill. (Pulverization step)

Thereafter, the finely pulverized mixture is incorporated and subjected to classification in a mechanical or aerial classifier, whereby particles with an intended particle size are obtained.

Thereafter, the particles obtained above are heated employing a circularity controlling device, whereby the circularity of the particles is controlled. As the circularity controlling device, there is a surfusion system (manufactured by NPK Co., Ltd.) controlling the circularity by bringing the particles in contact with hot air.

The resulting particles were added with an external additive to prepare the toner particles (A). As the external additive treatment device, there is a mechanically mixing apparatus such as a Henschel mixer or a coffee mill.

A circularity controlling device for controlling a circularity of the toner particles (A) will be explained.

Figure 3:
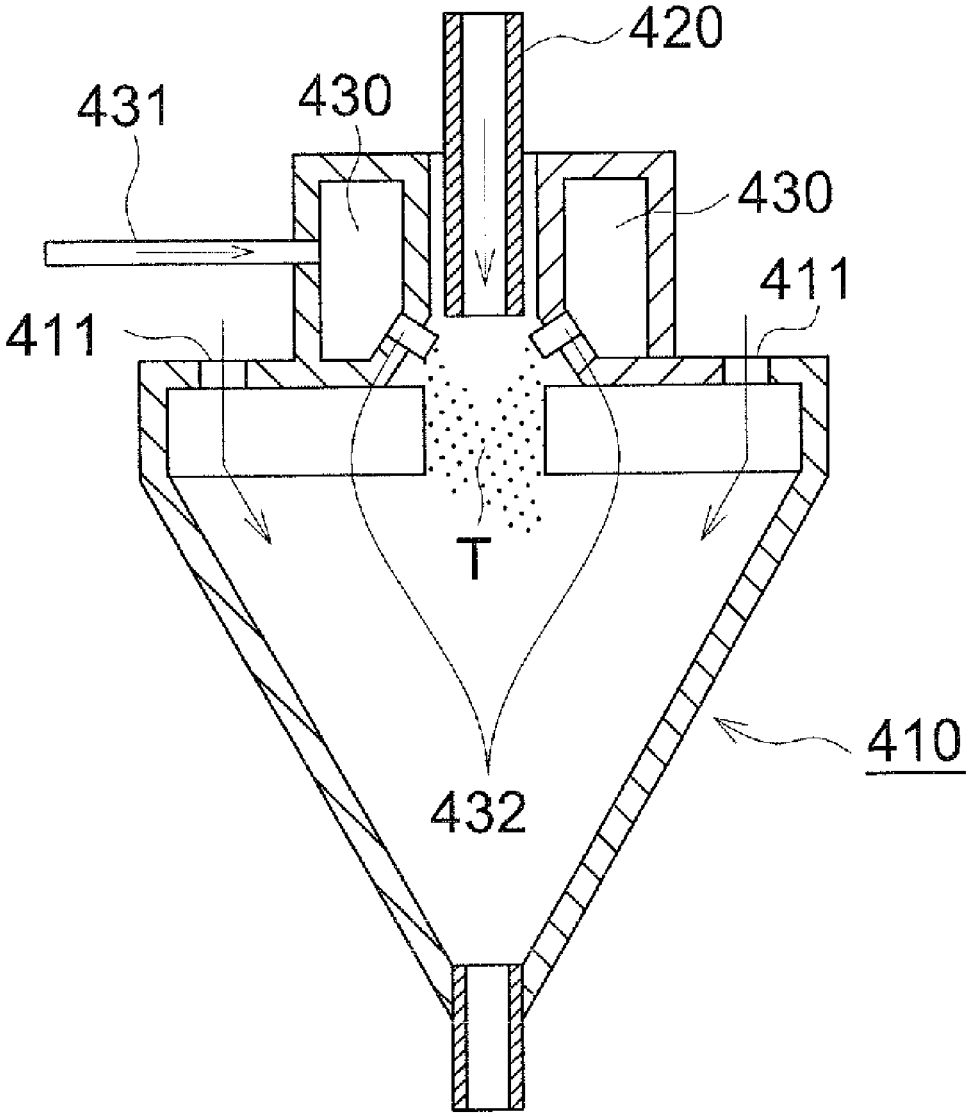
FIG. 3 is a schematic view showing one example of a circularity controlling device for controlling a circularity of the toner particles (A).

FIG. 3 is a schematic view showing one example of a circularity controlling device for controlling a circularity of the toner particles (A).

As is shown in FIG. 3, the circularity controlling device comprises a processing tank 410 for heat-treating particles with an intended particle size, a hot air supplying member 420 in the form of pipe above the processing tank, and a dispersion chamber 430 around the hot air supplying member 420. A material supplying member 431 for blowing a dispersion gas containing dispersed particles into the dispersion chamber 430 is connected to the outer circumference of the dispersion chamber 430, and plural material jetting nozzles 432 are provided in the inner circumference of the dispersion chamber 430, with a given distance in the circumference direction between the adjacent two jetting nozzles.

Hot air is jetted from the hot air supplying member 420 into the processing tank 410 and a dispersion gas containing dispersed toner particles (A) is blown into the dispersion chamber 430 through the material supplying member 431. The dispersion gas blown into the dispersion chamber 430 is jetted against hot air jetted from the hot air supplying member 420 from the material jetting nozzles 432 into the processing tank 410.

When the dispersion gas jetted from the material jetting nozzles 432 is jetted against the hot air, an angle formed between the dispersion gas current and the hot air current may be large. In this case, the dispersion gas is jetted to cross the hot air current, and is likely to collide with the hot air. Therefore, the particles in the dispersion gas are likely to aggregate.

On the other hand, an angle formed between current of the dispersion gas jetted from the material jetting nozzles 432 and that of the hot air jetted from the hot air supplying member 420 may be small. In this case, the dispersion gas is difficult to be incorporate into the hot air, and as a result, the particles of the dispersion gas are not subjected to sufficient heat treatment. In view of the above, the angle formed between current of the dispersion gas jetted from the material jetting nozzles 432 and that of the hot air jetted from the hot air supplying member 420 is from 20 to 40°, and preferably from 25 to 35°.

In the circularity controlling device as shown in FIG. 3, a current rectifying means is provided which rectifies current of a hot air jetting into the processing tank 410 from the hot air supplying member 420. Specifically, the interior of the hot air supplying member 420 is separated by a separating wall to form plural small paths of the hot air. Thus, hot air passes plural small paths separated by the separating wall in the hot air supplying member 420, whereby the hot air is rectified free from disorder and supplied in rectified form into the processing tank 410.

When the rectified hot air is jetted into the processing tank 420 from the hot air supplying member 410, a part of the particles in the particle dispersion gas is not away from the hot air and does not locally aggregate in the hot air, whereby the particles are uniformly heat treated. Further, when the heat treated particles are cooled with cold air incorporated into the processing tank 410 from the air inlet 411 provided at an upper portion of the processing tank 410, appropriate cooling is carried out, which prevents undesired aggregation of the particles.

Next, materials (resin, wax, colorant, etc.) used in the toner particles (A) will be explained.

As a resin constituting the toner particles (A), there is mentioned a polymer prepared by polymerization of polymerizable monomers. Typical examples of the polymer include a polymer prepared by polymerization of polymerizable monomers represented by vinyl monomers as shown in (1) through (10) below. Specific examples of the resin include a polymer prepared by polymerization carried out using vinyl monomers as shown below singly or in combination.

(1) Styrene or Styrene Derivatives:

styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene;

(2) Methacrylic Acid Ester Derivatives:

methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) Acrylic Acid Ester Derivatives:

methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate and phenyl acrylate;

(4) Olefins:

ethylene, propylene and isobutylene;

(5) Vinyl Esters:

vinyl propionate, vinyl acetate and vinyl benzoate;

(6) Vinyl Ethers:

vinyl methyl ether and vinyl ethyl ether;

(7) Vinyl Ketones:

vinyl methyl ketone, vinyl ethyl ketone and vinyl hexyl ketone;

(8) N-Vinyl Compounds:

N-vinyl carbazole, N-vinyl indole and N-vinyl pyrrolidone;

(9) Vinyl Compounds:

vinylnaphthalene and vinylpyridine;

(10) Acrylic Acid or Methacrylic Acid Derivatives acrylonitrile, methacrylonitrile and acrylamide.

As the polymerizable monomer constituting the resin, one having an ionic dissociation group can be used in combination. Examples of the ionic dissociation group include a substituent such as a carboxyl group, a sulfonic acid group or a phosphoric acid group. A monomer having an ionic dissociation group has this substituent.

Typical examples of the monomer having an ionic dissociation group will be listed below.

acrylic acid, methacrylic acid, maleic acid, itaconic acid, cinnamic acid, fumaric acid, monoalkyl maleate, and monoalkyl itaconate, styrene sulfonic acid, allylsulfosuccinic acid, 2-acrylamido-2-methylpropane sulfonic acid, acid phosphoxyethyl methacrylate, and 3-chloro-2-acid phosphoxypropyl methacrylate.

Further, a polyfunctional vinyl monomer is used as a polymerizable monomer constituting a resin to prepare a cross-linked resin.

Typical examples of the polyfunctional vinyl monomer include divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

(Wax)

As wax used in the preparation of the toner particles (A), there is mentioned a conventional wax. Typical examples thereof will be listed below.

(1) Long Chain Hydrocarbon. Wax polyolefin wax such as polyethylene wax or polypropylene wax, paraffin wax and sasol wax (2) Ester Wax trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, trimellitic acid tristarate, and distearyl meleate (3) Amide Wax ethylenediamine dibehenylamide and trimellitic acid tristearylamide (4) Dialkylketone Wax distearylketone (5) Others carnauba wax, and montan wax The melting point of wax is ordinarily 40 to 160° C., preferably 50 to 120° C., and still more preferably 60 to 90° C. A melting point falling within the above range ensures thermal stability of toners and can achieve stable toner image formation without causing cold offsetting even when fixed at a relatively low temperature. The wax content of the toner particles (A) is in the range of preferably from 1 to 30% by weight, and more preferably from 5 to 20% by weight.

<Colorant>

As the colorant constituting the toner particles (A), a known inorganic or organic colorant can be used. Specific examples of the colorants are shown below.

Examples of black colorants include carbon black such as furnace black, channel black, acetylene black, thermal black, lamp black and magnetic powder such as magnetite or ferrite.

Examples of colorants for magenta and red include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222, and the like.

Examples of colorants for orange and yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, and the like.

Examples of colorants for green and cyan include C.I. pigment blue 15, C.I. pigment blue 15:2, C.I. pigment blue 15:3, C.I. pigment blue 15:4, C.I. pigment blue 16, C.I. pigment blue 60, C.I. pigment blue 62, C.I. pigment green 7, and the like.

These colorants may be used singly or as an admixture of two or more kinds thereof.

The addition amount of the colorant in the toner is preferably from 1 to 30% by weight, and more preferably from 2 to 20% by weight, based on the weight of the toner particles (A).

As the colorant, a surface-modified one can be used. As the surface modifier, a known one can be used. Preferred examples of the surface modifier include a silane coupling agent, a titanium coupling agent, and an aluminum coupling agent.

<Charge Regulating Agent>

The toner particles (A) in the invention can optionally contain a charge regulating agent. As the charge regulating agent, there can be used various known compounds.

<External Additive>

The toner particles (A) in the invention can optionally contain an external additive.

The particle size of the external additive is preferably not more than 0.4 times the number-based median diameter ($D_{50}$) of the toner particles (A).

Addition of the external additive improves fluidity or electrostatic property of toner. The kind of the external additives is not specifically limited, and examples thereof include inorganic particles, organic particles and a lubricant, as described below.

There are usable commonly known inorganic particles and preferred examples thereof include silica, titanic, alumina and strontium titanate particles. There may optionally be used inorganic particles which have been subjected to hydrophobilization treatment.

Typical examples of silica particles include R-976, R-974, R-972, R-812 and R-809 which are commercially available from Nippon Acrosil Co., Ltd.; HVK-2150 and H-200 which are commercially available from Hoechst Co.; and TS-720, TS-530, TS-610, H-5 and MS-5 which are commercially available from Cabot Co.

Typical examples of titanic particles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which are commercially available from Fuji Titan Co., Ltd.; and IT-S, IT-OB and IT-OC which are commercially available from Idemitsu Kosan Co., Ltd.

Typical examples of alumina particles include RFY-C and C-604 which are commercially available from Nippon Aerosil Co., Ltd.; and TTO-55, which is commercially available from Ishihara Sangyo Co., Ltd.

As the organic particles, organic particles having a number-average primary particle size of 10 to 2000 nm are usable. Specifically, there is usable a homopolymer or copolymer of styrene or methyl methacrylate.

Typical examples of the lubricant include a zinc, copper, magnesium or calcium salt of stearic acid; a zinc, manganese, iron, copper or magnesium salt of oleic acid; a zinc, copper, magnesium or calcium salt of palmitic acid; a zinc or calcium salt of linolic acid; and a zinc or calcium salt of ricinolic acid.

The content of such an external additive or lubricant in the toner is preferably from 0.1 to 10.0% by weight, based on the weight of the toner particles (A). Addition of the external additive or lubricant can be conducted using various known mixing devices such as a turbuler mixer, a Henschel mixer, a Nauter mixer and a V-shape mixer.

(Preparation of Small Particles (B))

The small particles (B) in the invention are preferably one which is prepared by pulverizing resin powder in a mechanically pulverizing apparatus and classifying.

The average circularity or number-based median diameter ($D_{50}$) of the small particles (B) can be controlled by pulverization condition or classification condition.

As a resin constituting the small particles (B), one is used which has a surface energy different from that of the toner particles (A).

Examples of the resin include polyethylene (PE) resin, polypropylene (PP) resin, and polytetrafluoroethylene (PTFE) resin.

The small particles (B) may be added with an external additive like the toner particles (A).

<<Preparation of Toner>>

The toner of the invention can be prepared by mixing the toner particles (A) with the small particles (B) in an appropriate ratio.

The content in the toner of the small particles (B) is preferably from 0.2 to 20 part by weight based on 100 parts by weight of the toner particles (A).

As a mechanically mixing apparatus for mixing the toner particles (A) and the small particles (B), a known mechanically mixing apparatus such as a Henscher mixer or a coffee mill can be used.

<<Preparation of Developer>>

The toner of the invention is usable as a two-component developer comprised of a carrier and a toner or as a non-magnetic single-component developer comprised of a toner alone. The two-component developer is preferred in that a print image with high quality is obtained.

The two-component developer in the invention can be prepared by mixing 100 parts by weight of a carrier with 3 to 10 parts by weight of toner in a mechanically mixing apparatus.

The mixing method is not specifically limited and is carried out employing a known mixer.

The carrier constituting a two-component developer may be any of a non-coated carrier composed only of particles of a magnetic material such as iron or ferrite, a resin coated carrier in which the surface of particles of a magnetic material is coated with a resin, and a resin-dispersed carrier in which a resin and magnetic powder are mixed. The average particle size (by volume) of a carrier is preferably from 30 to 150 nm.

<<Image Formation>>

The toner of the invention is loaded in a white-black or color image formation apparatus comprising a cleaning blade cleaning a residual toner remaining on a photoreceptor, an intermediate transfer member or a secondary transfer member.

Herein, the residual toner refers to a toner remaining on a photoreceptor after image transfer, a toner remaining on an intermediate transfer belt after image transfer, or a patch image toner on a secondary transfer member.

In the color image formation apparatus, after a prescribed number of prints, the reflection density of a patch formed on an intermediate transfer member is measured through a detective sensor, and adjusted to be a value prescribed under controlled charging condition or development condition, whereby a print image with high quality is obtained continuously.

A patch image formed on a photoreceptor is transferred on an intermediate transfer member as it is, and the reflection density of the transferred patch image is detected through a detective sensor provided on the circumference of the intermediate transfer member. The charge condition or development condition is controlled by the reflection density of the patch image measured through a detective sensor so that a print image with stable and high quality is obtained continuously.

After the reflection density of the patch image is measured, the patch image toner on the intermediate transfer member is cleaned by an intermediate transfer member cleaning means described later or, the patch image toner, after transferred from the intermediate transfer member to a secondary transfer member, is cleaned by a secondary transfer member cleaning means.

Next, a color image formation method or an image formation apparatus preferably used in the invention will be explained.

Figure 4:
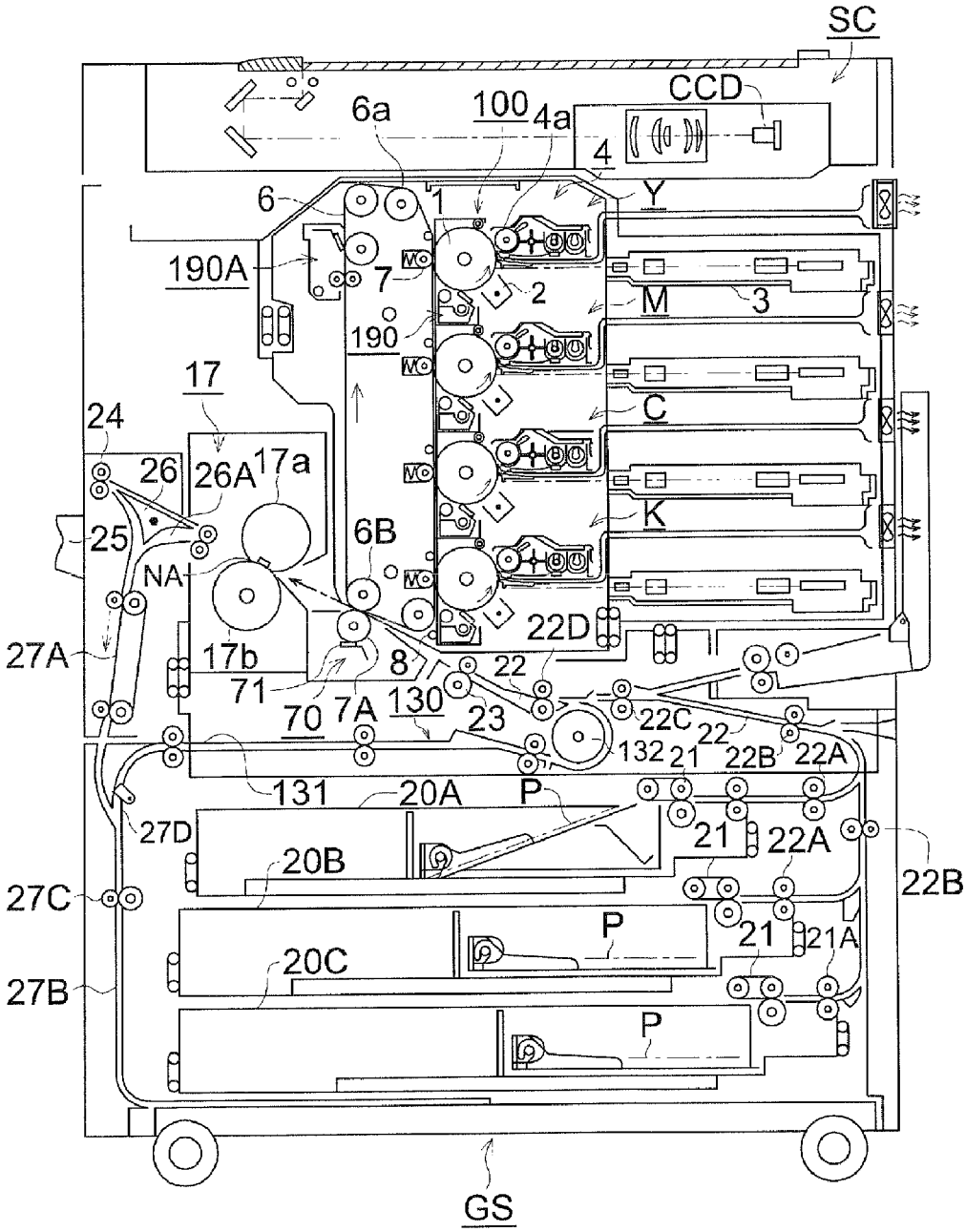
FIG. 4 is a sectional view showing one example of a color image formation apparatus employing the toner of the invention.

FIG. 4 is a sectional view showing one example of a color image formation apparatus employing the toner of the invention.

Firstly, an image formation apparatus for color electrophotography equipped with a detective sensor and a secondary intermediate transfer member will be outlined.

The image formation apparatus GS is called a tandem color image formation apparatus, in which an image formation unit forming a color toner image of each color of yellow, magenta, cyan and black colors is disposed, and each color toner image formed on an image carrier of each image formation unit is multi-transferred to and piled onto, an intermediate transfer member, and the piled color image is transferred together on a recording sheet.

An original image is set on an image reading device SC provided on the upper portion of an image formation apparatus GS, subjected to scanning exposure through an optical system, read by a line image sensor CCD, and then photoelectric-converted to an analog signal by the line image sensor CCD. The analog signal is subjected to an analog treatment, an A/D conversion, shading correction and an image compression treatment in an image processing section, and then transmitted to exposure optical system 3 as an image writing means as an image data signal.

As an intermediate transfer member, there are one in the form of drum and one in the form of endless belt, both of which have substantially the same function. In the invention, the intermediate transfer member refers to an intermediate transfer member 6 in the form of endless belt.

In the figure, four of a processing unit 100 for forming an image of each color of yellow (Y), Magenta (M), cyan (C) and black (K) are provided around the intermediate transfer member 6. In the process unit 100 as a color toner image formation means, Y, M, C and K are vertically provided in that order along the intermediate transfer member 6 in parallel with the vertical rotational direction of the intermediate transfer member 6 as shown in an arrow in the figure.

Four of the process unit have the common structure, and are comprised of a photoreceptor drum 1, a charging device 2 as a charging means, exposure optical system 3 for image writing, a development device 4, and a photoreceptor cleaning device 190 for an image carrier cleaning means.

The photoreceptor drum 1 comprises a cylindrical substrate made of metallic material such as aluminum whose outer diameter is from 40 to 100 mm and provided around the outer surface of the substrate, a photosensitive layer with a thickness of 20 to 40 μm. A driving force being applied from a driving source not illustrated, the photoreceptor drum 1, whose substrate is grounded, is rotated, for example, at a line speed of from 80 to 280 mm/s, and preferably at a line speed of 220 m/s in the direction as shown in an arrow.

An image formation section, in which a set of a charging device 2 as a charging means, exposure optical system 3 for image writing and a development device 4 is provided around the photoreceptor drum 1, is disposed along the rotation direction of the photoreceptor as shown in an arrow.

The charging device 2 as a charging means is disposed facing and adjacent to, the photoreceptor drum 1 in the direction parallel with the rotation axis of the photoreceptor drum 1. The charging device 2 has a discharge wire as a corona discharge electrode which provides a prescribed potential on the photoreceptive layer of the photoreceptor drum 1, and conducts corona discharge of the same polarity as toner (negative charge in the embodiment of the invention), whereby uniform potential is formed on the surface of the photoreceptor drum 1.

The exposure optical system 3 as an image writing means exposes the photoreceptor drum 1 to laser light emitted from a semiconductor laser (LD) not illustrated via a rotary polygon mirror (no numerical number is given) rotationally scanning in the main direction, a reflection mirror (no numerical number is given), and fθ lens (no numerical number is given) to write an electric signal corresponding to an image signal on the surface of the photoreceptor drum 1, whereby an electrostatic latent image corresponding to an original image is formed on the photoreceptive layer surface of the photoreceptor drum 1.

The development device 4 as a development means contains a two-component developer of each color of yellow (Y), magenta (M), cyan (C) and black (K), which is charged to have the same polarity as charging polarity of the photoreceptor drum 1. The development device 4 comprises a development roller 4*a*, which is a developer carrier formed of a non-magnetic stainless steel or aluminum cylinder having a thickness of 0.5 to 1 mm and an outer diameter of from 15 to 25 mm. The development roller 4*a* is disposed not to contact the photoreceptor drum 1, supported by a supporting roller (not illustrated), and to rotate in the same rotation direction as the photoreceptor drum 1. There are a space, for example, a space of 100 to 1000 μm between the development roller 4*a* and the photoreceptor drum 1. During development, the development roller 4*a* is subjected to application of direct current voltage or development bias voltage in which alternating current voltage is superposed on direct current voltage, each having the same polarity (minus polarity in the invention) as toner, whereby exposed portions of the photoreceptor drum 1 is subjected to reverse development.

As the intermediate transfer member 6, there is used a semiconductive seamless resin belt having a volume resistance of from $1.0\times10^{7}$ to $1.0\times10^{9}\Omega\cdot$m and a surface resistance of from $1.0\times10^{10}$ to $1.0\times10^{12}\Omega/\square$. As the resin belt, there is used a semiconductive resin film with a thickness of from 0.05 to 0.5 mm in which a conductive material is dispersed in an engineering plastic such as modified polyimide, heat-cured polyimide, ethylene/tetrafluoroethylene copolymer, polyvinylidene fluoride, or nylon alloy. As the intermediate transfer member 6, there is also used a semiconductive rubber belt with a thickness of from 0.05 to 2.0 mm in which a conductive material is dispersed in silicon rubber or urethane rubber. The intermediate transfer member 6 is supported to be rotated in the vertical direction by a tension roller 6 or plural rollers including backup roller 6B opposing the secondary transfer member.

A primary transfer roller 7 as a primary transfer member for each color is composed of a roll-shaped conductive material, for example, employing foamed rubber such as silicone or urethane, and disposed facing the photoreceptor drum 1 through an intermediate transfer member 6. The rear surface of the intermediate transfer member 6 being pressed by the primary transfer roller 7, a transfer area is formed between the primary transfer roller 7 and the photoreceptor drum 1. A constant direct current of polarity (positive polarity in the invention) opposite to toner being applied to the primary transfer roller 7 by constant current control, a toner image on the photoreceptor drum 1 is transferred to the intermediate transfer member 6 by transfer electric field formed at the transfer area.

The toner image transferred onto the intermediate transfer member 6 is transferred to a recording sheet P. A detective sensor 8, which measures the density of a patch image, is disposed adjacent to the peripheral surface of the intermediate transfer member 6.

A cleaning device 190A is disposed in order to clean the residual toner on the intermediate transfer member 6.

Further, a secondary transfer device 70 is disposed in order to clean a patch image toner on a secondary transfer member 7A.

Next, an image formation process will be explained.

When image recording is started, the photoreceptor drum 1 is rotated in the direction as shown in an arrow by a photoreceptor driving motor not illustrated, and is charged by the charging device 2 for Y. The charged photoreceptor drum 1 is subjected to exposure (image-writing) through the exposure optical system 1 for Y according to electric signals corresponding to image data of a first color signal, i.e., Y, so that a latent image corresponding to a yellow (Y) image is formed on the photoreceptor drum 1 for Y. The resulting latent image is subjected to reverse development by the development device 4 for Y to form a toner image of a yellow (Y) toner on the photoreceptor drum 1 for Y. The Y toner image on the photoreceptor drum 1 for Y is transferred to the intermediate transfer member 6 through a primary transfer roller 7 as a primary transfer member.

Subsequently, the photoreceptor drum 1 is charged by the charging device 2 for M. The charged photoreceptor drum 1 is subjected to exposure (image-writing) through the exposure optical system 1 for M according to electric signals corresponding to image data of a first color signal, i.e., M, so that a latent image corresponding to a yellow (M) image is formed on the photoreceptor drum 1 for M. The resulting latent image is subjected to reverse development by the development device 4 for M to form a toner image of a magenta (M) toner on the photoreceptor drum 1 for M. The M toner image formed on the photoreceptor drum 1 for M is transferred to the intermediate transfer member 6 through a primary transfer roller 7 as a primary transfer member, which is superposed on the Y toner image.

Similarly, a C toner image formed on the photoreceptor drum 1 for C and a K toner image formed on the photoreceptor drum 1 for K in that order are piled on the intermediate transfer member 6. Thus, a piled color toner image composed of Y, M, C and K toners is formed on the peripheral surface of the intermediate transfer member 6.

After the image transfer the residual toner on the peripheral surface of the photoreceptor drum 1 is cleaned by a photoreceptor cleaning device 190.

A recording sheet P as a recording paper stored in paper feed cassettes 20A, 20B and 20C is fed by a paper delivery roller 21 and a paper feed roller 22A housed in feeding cassettes 20A, 20B and 20C, respectively, and guided to a transport path 22 through transporting rollers 22B, 22C, and 22D, then through a resist roller 23, and to a secondary transfer member 7A as a secondary transfer means, in which voltage (having a positive polarity in the invention) is applied, where superposed color images formed onto an intermediate transfer member 6, on which image portions on the secondary transfer member 7A are transferred, are transferred together on the recording sheet P.

The recording sheet P with the transferred color images is hot pressed at a nip portion NA between a heating member 17*a* and a pressure roller 17*b* in a fixing device 17, and fixed by a heat-roll type fixing device 24, nipped by a paper discharge roller 24, and put onto a paper discharge tray 25 outside the apparatus.

The above explains a process in which an image is formed on a first surface which is one surface of both surfaces of the recording sheet P. When both surfaces of the recording sheet are printed, sheet guide portion 26A is opened by paper discharge switching member 26, the recording sheet P is transported in the direction as shown in a broken line.

The recording sheet P is transported to a transport path 27B on the lower side through a transport means 27A, switched back by a sheet reverse member 27C, and made to change the transportation path at a separation portion 27D, whereby the trailing end of the recording sheet P is changed to the leading end, and the recording sheet P is transported in a paper feed unit 130 for both surface copying.

The recording sheet P moves in the paper feeding direction in a transport guide 131 provided in the paper feed unit 130 for both surface copying, re-fed by a paper delivery roller 132, and guided to the transport path 22 above.

The recording sheet P is transported to the secondary transfer member 7A, as described above, made to transfer a toner image to a second surface thereof, which is the other surface thereof, then fixed by a fixing device 17, and put onto a paper discharge tray 25.

After a color image is transferred onto the recording sheet P by a secondary transfer member 7A as a secondary transfer means, any residual toner remaining on the intermediate transfer member 6 from which the recording member P has been separated is removed by a cleaning means 190A.

Further, a patch toner image on the secondary transfer member 7A is cleaned by the cleaning blade 71 of the secondary transfer device 70.

Next, a cleaning means for cleaning a member to be cleaned will be explained.

Figure 5:
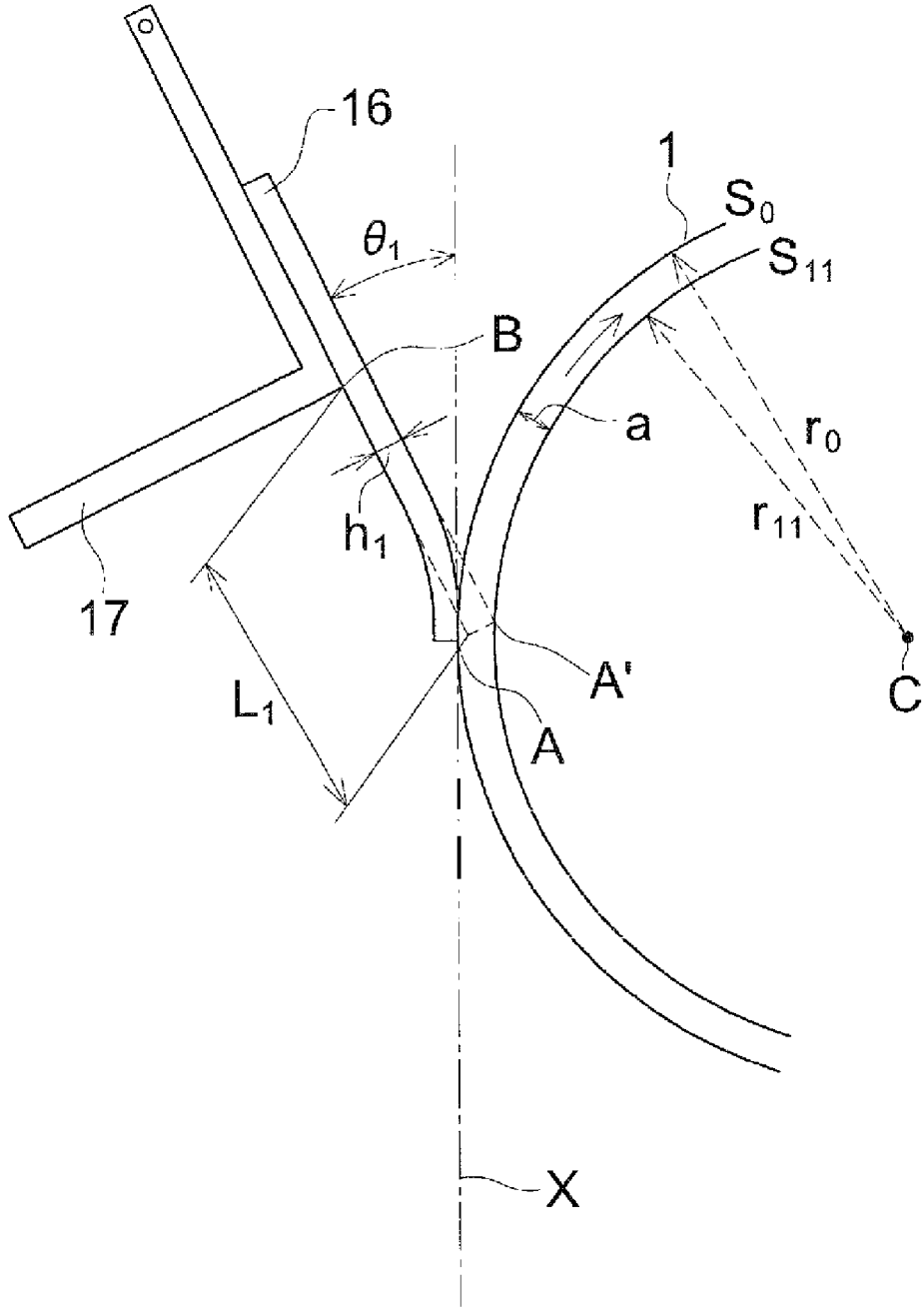
FIG. 5 is a schematic view showing one example of a cleaning means for cleaning a photoreceptor.

FIG. 5 is a schematic view showing one example of a cleaning means for cleaning a photoreceptor.

In FIG. 5, the photoreceptor is represented by numerical number 1, and the touching angle of the cleaning blade is represented by θ1. The free length $L_1$ of the cleaning blade 16 is the length from the end B of a blade holder 17 to the end A' of the cleaning blade assumed that it is not deformed (shown by a broken line in the illustration). The thickness of the cleaning blade is shown by $h_1$. The cleaning blade touching angle $\theta_1$ is an angle formed between a tangential line X at the touching point A of the photoreceptor and the cleaning blade assumed that it is not deformed. Press-in depth a is the difference between the diameter $r_0$ of the circumstance $s_0$ of the photoreceptor and the diameter $r_{11}$ of the circle $s_{11}$ having the same center axis C as the photoreceptor and having on the circumference the end point A' of the cleaning blade assumed that it is not deformed. The touching angle $\theta_1$ of the cleaning blade with the photoreceptor is preferably from 5° to 35°. When the touching angle is within the above range, the cleaning fault of the toner remaining after transfer or turning up of the cleaning blade (a state in which the tip end of the cleaning blade is turned from the counter direction into the rotating direction of the photoreceptor) is not caused, which is preferred.

The free length of the cleaning blade is preferably from 6 to 15 mm, and the thickness of the cleaning blade is preferably from 0.5 to 10 mm.

As the material of the cleaning blade, urethane rubber, silicone rubber, fluorine-containing rubber, chloroprene rubber and butadiene rubber are usable. Among them, urethane rubber is preferred is view of excellent anti-wearing property.

The shape and the material of the cleaning blade can be suitably decided depending on various conditions such as properties of the toner, properties of the photoreceptor, and the touching angle or touching pressure of the cleaning blade.

Figure 6:
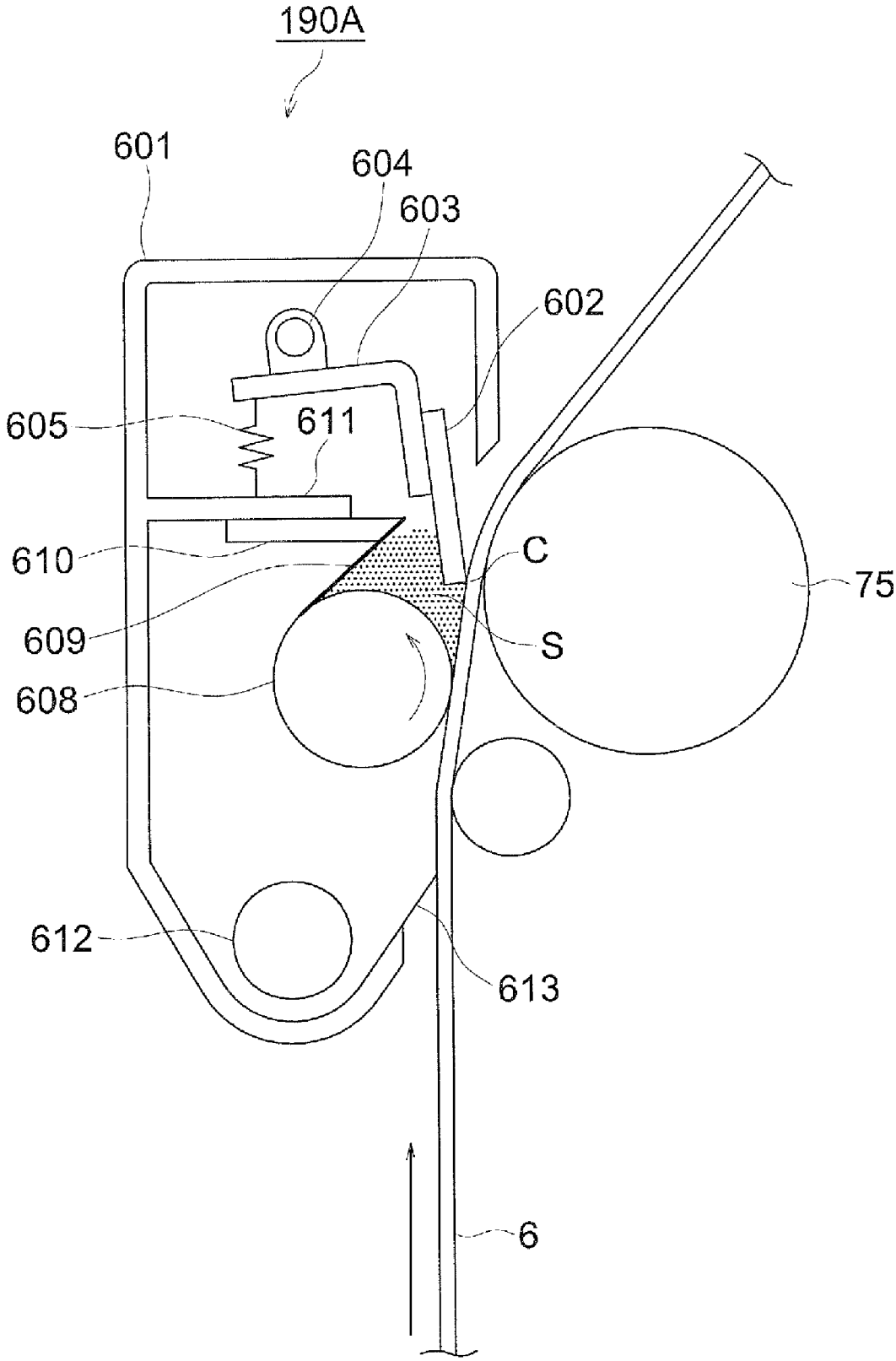
FIG. 6 is a schematic view showing one example of a cleaning means for cleaning an intermediate transfer member.

FIG. 6 is a schematic view showing one example of a cleaning means for cleaning an intermediate transfer member.

In FIG. 6, the numerical number 601 denotes a casing, which is provided with various members constituting the cleaning means 190A and with a toner collecting section for collecting toner removed from the intermediate transfer member 6.

The numerical number 602 denotes a cleaning blade made of an elastic body such as urethane rubber. This blade is fastened onto the blade holder 603 by an adhesive or the like.

The blade holder 603 is rotatably supported by a supporting shaft 604 provided in the casing 601.

The numerical number 605 indicates a press spring. It supplies bias in such a way that the blade holder 603 rotates around the supporting shaft 604 in the counterclockwise direction, and is arranged so that the end of the cleaning blade 602 faces the intermediate transfer member 6 in the direction (in the counter direction) against the rotational direction of the intermediate transfer member 6 and contact pressure of the end is applied to the intermediate transfer member 6 backed up by a backup roller 75 at the contact pressure-applying position C.

The numerical number 608 is a toner guide member made of a sponge roller. This roller contacts the intermediate transfer member 6 upstream of the contact pressure-applying position C in the rotating direction of the intermediate image member 6, the cleaning blade 602 contacting the intermediate transfer member 6 at the contact pressure-applying position C.

The sponge roller 608 is provided at the position in contact with the intermediate transfer member 6 to rotate in the same direction as the intermediate transfer member 6 with a rotary means not illustrated, where the speed of the rotation of the sponge roller 608 is higher than that of the intermediate transfer member 6.

The numerical number 609 is a toner ejection-regulating member made of a polyester resin (PET) sheet. One end thereof contacts the surface of the sponge roller 608 at the position of the surface of the sponge roller 608 opposite the contact position between the sponge roller 608 and the intermediate transfer member 6, and the other end is fixed on the sheet holding member 610 provided above the sponge roller 608 by means of double-faced adhesive tape or the like.

The sheet holding member 610 is fixed on the projection 611 of the casing 601 by means of screws or the like.

The aforementioned structure forms a space S enclosed by an intermediate transfer member 6, the cleaning blade 602, the sponge roller 608, and the toner ejection-regulating member 609.

The numerical number 612 is a recovery screw provided on the bottom of the casing 601. The residual toner stored on the bottom of the casing 601 is transported in the direction perpendicular to the page surface of the drawing, and is discharged out of the casing 601.

The numerical number 613 is a toner-receiving sheet made of PET. The one end thereof is fixed to the bottom of the casing 601 facing the intermediate transfer member 6, and the other end contacts the intermediate transfer member, which prevents the toner remaining inside the casing 601 from falling downwards.

In FIG. 6, the cleaning blade is made of urethane rubber, and has a hardness 74° (JIS, A rubber hardness), whose end contacts the intermediate transfer member 6 at a contact pressure of 16.0. The cleaning blade has a free length of preferably from 6 to 15 mm, and a thickness of preferably from 0.5 to 10 mm.

FIG. 7 is a schematic view showing one example of a secondary transfer member.

The shape of the secondary transfer member of a secondary transfer device 70 is not specifically limited, and may be in the form of roller or in the form of belt.

Figure 7A:
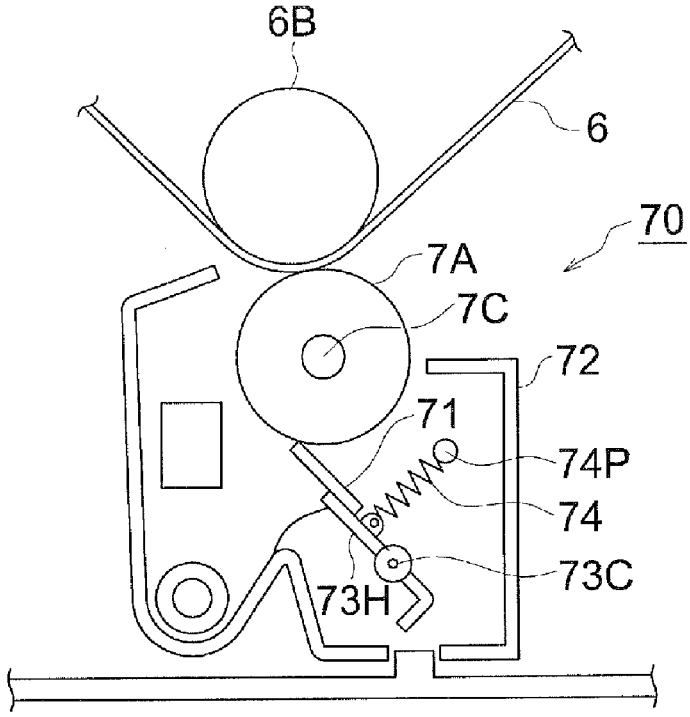
FIG. 7*a* is a schematic view of a cleaning means of a secondary transfer roller employed as a secondary transfer member.

FIG. 7*a* is a schematic view of a cleaning means of a secondary transfer roller employed as a secondary transfer member.

In FIG. 7*a*, the secondary transfer member 7A pressure contacts the back up roller 6B through the intermediate transfer member 6, and the cleaning blade 71 pressure contacts the intermediate transfer member 6.

The secondary transfer device 70 comprises the secondary transfer roller 7A and its cleaning section, in which a rotation shaft 7C of the secondary transfer roller 7A, a rotation supporting shaft 73C of a cleaning blade holding member 73H of the cleaning blade 71 in the cleaning section, and a fixing pin 74P, which fixes one end of a spring 74 fixed to the cleaning blade holding member 73H at the other thereof, are fixed to a housing 72 of the secondary transfer device 70.

In the above embodiment, the spring 74 is fixed to the housing 72 at one end thereof and to the cleaning blade holding member 73H at the other thereof.

Figure 7B:
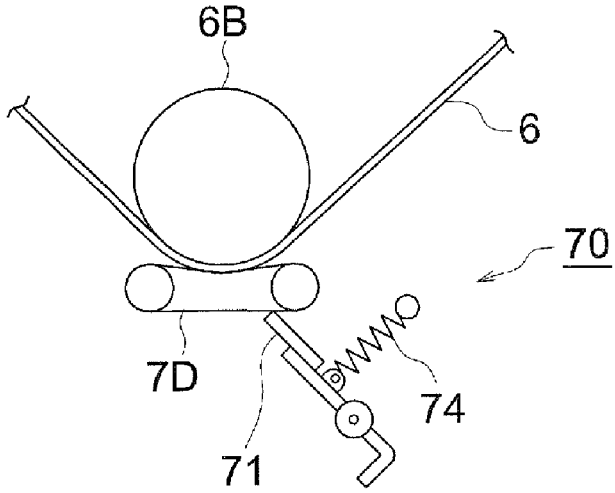
FIG. 7*b* is a schematic view of a cleaning means of an endless belt employed as a secondary transfer member.

FIG. 7*b* is a schematic view of a cleaning means of an endless belt employed as a secondary transfer member.

In FIG. 7*b*, an endless belt 7D is employed in place for the secondary transfer roller 7A as shown in FIG. 7*a*.

In FIGS. 7*a* and 7*b*, the cleaning blade 71 is made of urethane rubber. The cleaning blade has a free length of 9 mm, and a thickness of 2 mm. The spring 74 has a spring force of 18.3 N/m. The contact pressure to the secondary transfer member of the end of the spring 74 contacting the secondary transfer member is 13.7 N/m.

EXAMPLES

Next, the present invention will be explained in detail, employing examples, but the invention is not limited thereto.

<<Preparation of Toner>>

The toner was prepared as follows.

<Preparation of Toner Particles (A)>

(Preparation of Resin Particle Dispersion Solution 1)

There were mixed 201 parts by weight of styrene, 117 parts by weight of butyl acrylate and 18.3 parts by weight of methacrylic acid to prepare a monomer mixture solution. The monomer mixture solution was heated to 80° C. with stirring, and gradually added with 172 parts by weight of behenyl behenate to prepare a monomer solution.

Subsequently, an aqueous surfactant solution, in which 3 parts by weight of an anionic surfactant, dodecylbenzene sulfonic acid are dissolved in 1182 parts by weight of pure water, was heated to 80° C., added with the monomer solution, and stirred at a high-speed to prepare a monomer dispersion solution.

Then, 867.5 parts by weight of pure water was placed into a polymerization device fitted with a stirrer, a condenser, a temperature sensor and a nitrogen-introducing tube, and the internal temperature of the device was adjusted to 80° C. with stirring under a nitrogen atmosphere. The monomer dispersion solution was introduced into the polymerization device and an aqueous polymerization initiator solution, in which 8.55 g of potassium persulfate were dissolved in 162.5 parts by weight of pure water, was further added thereto.

After addition of the aqueous polymerization initiator solution, 5.2 parts by weight of n-octylmercatan were further added thereto in 35 minutes, and polymerization reaction was conducted at 80° C. for 2 hours. Subsequently, an aqueous polymerization initiator solution, in which 9.96 parts by weight of potassium persulfate was dissolved in 189.3 parts by weight of pure water, was added thereto, and then, a mixed monomer solution of 366.1 parts by weight of styrene, 179.1 parts by weight of butyl acrylate and 7.2 parts by weight of n-octylmercaptan was dropwise added in 1 hour. After completion of addition, polymerization reaction was conducted for additional 2 hours, and then, the resulting reaction mixture was cooled to room temperature to prepare a resin particle dispersion solution 1.

(Preparation of Resin Particle Dispersion Solution for Shelling)

Pure water of 2948 parts by weight and 1 part by weight of an anionic surfactant, dodecylbenzene sulfonic acid were placed into a polymerization device fitted with a stirrer, a condenser, a nitrogen-introducing tube and a temperature sensor, and stirred to obtain a surfactant solution, The resulting surfactant solution was heated to a temperature of 80° C. under nitrogen atmosphere. Separately, there were prepared a monomer mixture solution in which 520 parts by weight of styrene, 184 parts by weight of butyl acrylate, 96 parts by weight of methacrylic acid and 22.1 parts by weight of n-octylmercaptan were mixed, and an aqueous polymerization initiator solution, in which 10.2 parts by weight of potassium persulfate were dissolved in 218 parts by weight of pure water. The aqueous polymerization initiator solution was incorporated into the polymerization device and then the monomer mixture solution was dropwise added thereto in 3 hours. The resulting reaction solution was further subjected to polymerization reaction for additional 1 hour, and then cooled to room temperature. Thus, a resin particle dispersion solution for shelling was prepared. The resin particle dispersion solution for shelling contained resin particles for shelling having a weight average molecular weight of 13,200 and a weight average particle size of 82 nm.

(Cyan Colorant Dispersion Solution)

Sodium dodecyl sulfate of 11.5 parts by weight were dissolved in 160 parts by weight of pure water, and 25 parts by weight of C.I. Pigment Blue 15:3 were gradually added thereto. The resulting mixture solution was then dispersed through CLEAR. MIX W-motion CLM-0.8 (product by M Technique Co.). Thus, a cyan colorant dispersion solution was prepared which contained cyan colorant particles having a number-based median diameter ($D_{50}$) of 153 nm.

(Magenta Colorant Dispersion Solution)

A magenta colorant dispersion solution was prepared in the same manner as the cyan colorant dispersion solution above, except that C.I. Pigment Blue 15:3 was replaced by C.I. Pigment Red 122. The magenta colorant dispersion solution contained magenta colorant particles having a number-based median diameter ($D_{50}$) of 183 nm.

(Yellow Colorant Dispersion Solution)

A yellow colorant dispersion solution was prepared in the same manner as the cyan colorant dispersion solution above, except that C.I. Pigment Blue 15:3 was replaced by C.I. Pigment yellow 74. The yellow colorant dispersion solution contained yellow colorant particles having a number-based median diameter ($D_{50}$) of 177 nm.

(Black Colorant Dispersion Solution)

A black colorant dispersion solution was prepared in the same manner as the cyan colorant particle dispersion solution above, except that C.I. Pigment Blue 15:3 was replaced by carbon black, Mogul L. The black colorant dispersion solution contained carbon black particles having a number-based median diameter ($D_{50}$) of 167 nm.

<Preparation of Toner Particles (A)C>

(Preparation of Toner Particles (A)C1)

The resin particle dispersion solution 1 of 357 parts by weight in terms of solid content, 68 parts by weight in terms of solid content of polyester ionomer resin (FINETEX ES-2200), 900 parts by weight of deionized water and 200 parts by weight in terms of solid content of the cyan colorant dispersion solution were introduced into a reaction device fitted with a stirrer, a temperature sensor and a condenser. While maintaining the internal temperature of the reaction device at 30° C., the resulting mixture solution was added with an aqueous 5 mol/liter sodium hydroxide solution to adjust to a pH of 10.

Subsequently, an aqueous solution, in which 2 parts by weight of magnesium chloride hexahydrate were dissolved in 1000 parts by weight of deionized water, was dropwise added to the mixture solution in 10 minutes, and then heated to 75° C. so that the particles were subjected to coagulation and fusion to produce coagulated particles. Further, heat and stirring was continued until the number-based median diameter ($D_{50}$) of the coagulated particles reached 5.3 μm, the size of the coagulated particles being observed by Multisizer 3 (product by Beckman Coulter Co.).

When the number-based median diameter ($D_{50}$) of the core particles reached 5.3 μm, 210 parts by weight in terms of solid content of the resin particle dispersion solution for shell were added thereto, and stirring was continued for 1 hour so that the resin particles for shell were fuse-adhered to the surface of the core particles. Stirring was further continued for 30 minutes to complete shell layer formation and then, a sodium chloride aqueous solution, in which 40 parts by weight of sodium chloride were dissolved in 500 parts by weight of deionized water, was added, heated at 78° C., stirred at 78° C. for 1 hour, cooled to room temperature to form particles. The thus formed particles were repeatedly washed with deionized water and then dried with hot air of 35° C. to obtain dry particles C1.

One part by weight of hydrophobic silica (having a number average primary particle size of 12 nm and a hydrophobicity of 68) and one part by weight of hydrophobic titanium oxide (having a number average primary particle size of 20 nm and a hydrophobicity of 64) were added to 100 parts by weight of the dry particles C1, and subjected to mixing treatment in a Henschel mixer (product by Mitsui Miike Kakoki Co., Ltd.). Thereafter, coarse particles were removed using a sieve having a 45 μm opening to obtain toner particles (A)C1.

The number-based median diameter ($D_{50}$) of the thus obtained toner particles (A)C1 was 5.5 μm, determined by Multisizer 3 (product by Beckman Coulter Co., Ltd.). The average circularity of the toner particles (A)C1 was 0.97, determined by FPIA 2100 (product by Sysmex Co.).

(Preparation of Toner Particles (A)C2 through (A)C5)

Toner particles (A) C2 through (A)C5 were prepared in the same manner as in toner particles (A)C1, except that the coagulation and fusion condition was changed.

<Preparation of Toner Particles (A)M>

(Preparation of Toner Particles (A)M1 through (A)M5)

Toner particles (A) M1 through (A)M5 were prepared in the same manner as in toner particles (A)C1 through (A)C5, respectively, except that the cyan colorant dispersion solution was changed to the magenta colorant dispersion solution.

<Preparation of Toner Particles (A)Y>

(Preparation of Toner Particles (A)Y1 through (A)Y5)

Toner particles (A)Y1 through (A)Y5 were prepared in the same manner as in toner particles (A)C1 through (A)C5, respectively, except that the cyan colorant dispersion solution was changed to the yellow colorant dispersion solution.

<Preparation of Toner Particles (A)K>

(Preparation of Toner Particles (A)K1 through (A)K5)

Toner particles (A)K1 through (A)K5 were prepared in the same manner as in toner particles (A)C1 through (A)C5, respectively, except that the cyan colorant dispersion solution was changed to the carbon black dispersion solution.

(Preparation of Toner Particles (A)C6)

Polyester resin of 100 parts by weight, 3.5 parts by weight of C.I. Pigment Blue 15:3, 2 parts by weight of zinc salicylate and 5 parts by weight of carnauba wax were sufficiently mixed. The resulting mixture was sufficiently kneaded in a continuous biaxial extruder, a TYPE KTK biaxial extruder produced by Kobe Seikosho Co., Ltd., cooled, roughly pulverized in a hammer mill, then finely pulverized in a finely pulverizing device employing a jet stream, and classified in a classifier employing a circling stream to obtain particles. The resulting particles were subjected to spherical treatment in a circularity controlling apparatus as shown in FIG. 2. Thus, toner particles (A)C6 were prepared.

The number-based median diameter ($D_{50}$) of the thus prepared toner particles (A)C6 was 5.5 μm, determined by Multisizer 3 (Product by Beckman Coulter Co., Ltd.). The average circularity of the toner particles (A)C6 was 0.94, determined by FPIA 2100 (product by Sysmex Co.).

(Preparation of Toner Particles (A)M6)

Toner particles (A)M6 were prepared in the same manner as in toner particles (A)C6, except that C.I. Pigment Blue 15:3 was changed to C.I. Pigment red 122.

(Preparation of Toner Particles (A)Y6)

Toner particles (A)Y6 were prepared in the same manner as in toner particles (A)C6, except that C.I. Pigment Blue 15:3 was changed to C.I. Pigment yellow 74.

(Preparation of Toner Particles (A)K6)

Toner particles (A)K6 were prepared in the same manner as in toner particles (A)C6, except that C.I. Pigment Blue 15:3 was changed to Mogul L.

The average circularity, number-based median diameter ($D_{50}$) and surface energy of the toner particles (A)C1 through (A)C6 are shown in Table 1.

TABLE 1

| Toner Particles (A) C | Resin | Number-Based Median Diameter ($D_{50}$) (μm) | Average Circularity | Surface Energy ($\times 10^{-3}$ N/m) | Preparation Method |
|---|---|---|---|---|---|
| (A) C1 | Acryl/Styrene | 5.5 | 0.97 | 38 | *1 |
| (A) C2 | Acryl/Styrene | 3.0 | 0.99 | 38 | *1 |
| (A) C3 | Acryl/Styrene | 8.0 | 0.93 | 38 | *1 |
| (A) C4 | Acryl/Styrene | 2.5 | 0.91 | 38 | *1 |
| (A) C5 | Acryl/Styrene | 8.2 | 0.90 | 38 | *1 |
| (A) C6 | Polyester | 5.5 | 0.94 | 43 | *2 |

*1: Polymerization method

*2: Pulverizing method

In Table 1, the average circularity, number-based median diameter ($D_{50}$) and surface energy are those measured according to the methods described above.

The average circularity, number-based median diameter ($D_{50}$) and surface energy of toner particles (A)M1 through (A)M6, toner particles (A)Y1 through (A)Y6, toner particles (A)K1 through (A)K6 were the same as those of toner particles (A)C1 through (A)C6, respectively, although not specified here.

<Preparation of Small Particles (B)>

(Preparation of Small Particles (B)1)

Polytetrafluoroethylene resin powder was pulverized in a mechanical pulverizing apparatus and classified to prepare small particles (B)1 having a number-based median diameter ($D_{50}$) of 3.0 μm and an average circularity of 0.80.

(Preparation of Small Particles (B)2 through (B)6)

Small particles (B)2 through (B)6 were prepared in the same manner as in Small particles (B)1, except that classification condition was changed.

(Preparation of Small Particles (B)7)

Acryl-styrene resin powder was pulverized in a mechanical pulverizing apparatus and classified to prepare small particles (B)7 having a number-based median diameter ($D_{50}$) of 3.0 μm and an average circularity of 0.80.

(Preparation of Small Particles (B)8)

Nylon resin powder was pulverized in a mechanical pulverizing apparatus and classified to prepare small particles (B)8 having a number-based median diameter ($D_{50}$) of 3.0 μm and an average circularity of 0.80.

(Preparation of Small Particles (B)9)

Silicone resin powder was pulverized in a mechanical pulverizing apparatus and classified to prepare small particles (B)9 having a number-based median diameter ($D_{50}$) of 3.0 μm and an average circularity of 0.80.

The circularity, number-based median diameter ($D_{50}$) and surface energy of the toner particles (B)1 through (B)9 are shown in Table 2.

TABLE 2

| Small Particles (B) | Resin | Number-Based Median Diameter ($D_{50}$) (μm) | Average Circularity | Surface Energy ($\times 10^{-3}$ N/m) |
|---|---|---|---|---|
| (B)1 | *PTFE | 3.0 | 0.80 | 18 |
| (B)2 | *PTFE | 0.45 | 0.70 | 18 |
| (B)3 | *PTFE | 4.8 | 0.92 | 18 |
| (B)4 | *PTFE | 0.75 | 0.70 | 18 |
| (B)5 | *PTFE | 3.0 | 0.94 | 18 |
| (B)6 | *PTFE | 3.0 | 0.67 | 18 |
| (B)7 | Acryl/Styrene | 3.0 | 0.80 | 38 |
| (B)8 | Nylon | 3.0 | 0.80 | 46 |
| (B)9 | Silicone | 3.0 | 0.80 | 16 |

**PTFE: Polytetrafluoroethylene

In Table 2, the average circularity, number-based median diameter ($D_{50}$) and surface energy are those measured according to the methods described above.

<Preparation of Toner>

The toner particles (A)C and small particles (B) each prepared above were mixed in an amount as shown in Table 3, and mixed at 20° C. and at 50% RH at a circumference speed of 40 m/s for 5 minutes in a Henschel mixer (produced by Mitsui Miike Kogyo Co., Ltd.). Thus, cyan color toners C1 through C17 were prepared.

In the cyan color toners C1 through C17 prepared above, the amount of toner particles (A)C and small particles (B) and the surface energy difference between toner particles (A)C and small particles (B) are shown in Table 3.

TABLE 3

| Cyan | Toner Particles (A) C | | | | Small Particles (B) | | | | | Surface |
|---|---|---|---|---|---|---|---|---|---|---|
| Color Toner No. | Kinds | *1 (μm) | Surface Energy ($\times 10^{-3}$ N/m) | Parts by Weight | Kinds | *1 (μm) | Surface Energy ($\times 10^{-3}$ N/m) | Parts by Weight | *2 | Energy Difference ($\times 10^{-3}$ N/m) |
| C1 | (A) C1 | 5.5 | 38 | 100 | (B) 1 | 3.0 | 18 | 3 | 0.55 | 20 |
| C2 | (A) C1 | 5.5 | 38 | 100 | (B) 1 | 3.0 | 18 | 20 | 0.55 | 20 |
| C3 | (A) C1 | 5.5 | 38 | 100 | (B) 1 | 3.0 | 18 | 0.2 | 0.55 | 20 |
| C4 | (A) C1 | 5.5 | 38 | 100 | (B) 1 | 3.0 | 18 | 30 | 0.55 | 20 |
| C5 | (A) C1 | 5.5 | 38 | 100 | (B) 1 | 3.0 | 18 | 0.1 | 0.55 | 20 |
| C6 | (A) C2 | 3.0 | 38 | 100 | (B) 2 | 0.45 | 18 | 3 | 0.15 | 20 |
| C7 | (A) C3 | 8.0 | 38 | 100 | (B) 3 | 4.8 | 18 | 3 | 0.60 | 20 |
| C8 | (A) C4 | 2.5 | 38 | 100 | (B) 2 | 0.45 | 18 | 3 | 0.18 | 20 |
| C9 | (A) C5 | 8.2 | 38 | 100 | (B) 3 | 4.8 | 18 | 3 | 0.59 | 20 |
| C10 | (A) C1 | 5.5 | 38 | 100 | (B) 4 | 0.75 | 18 | 3 | 0.14 | 20 |
| C11 | (A )C1 | 5.5 | 38 | 100 | (B) 3 | 4.8 | 18 | 3 | 0.87 | 20 |
| C12 | (A) C1 | 5.5 | 38 | 100 | (B) 5 | 3.0 | 18 | 3 | 0.55 | 20 |
| C13 | (A) C1 | 5.5 | 38 | 100 | (B) 6 | 3.0 | 18 | 3 | 0.55 | 20 |
| C14 | (A) C1 | 5.5 | 38 | 100 | (B) 7 | 3.0 | 38 | 3 | 0.55 | 0 |
| C15 | (A) C6 | 5.5 | 43 | 100 | (B) 7 | 3.0 | 38 | 3 | 0.55 | 5 |
| C16 | (A) C6 | 5.5 | 43 | 100 | (B) 8 | 3.0 | 46 | 3 | 0.55 | 3 |
| C17 | (A) C1 | 5.5 | 38 | 100 | (B) 9 | 3.0 | 16 | 3 | 0.55 | 22 |

*1: Number-Based Median Diameter ($D_{50}$)

*2: $D_{50}$ of Small particles (B)/$D_{50}$ of Toner particles (A) C

Magenta color toners M1 through M17, yellow color toners Y1 through Y17, and black color toners K1 through K17 were prepared in the same manner as in cyan color toners C1 through C17, respectively.

<Preparation of Developer>

Each color toner prepared above was mixed with a carrier having an average particle size of 35 μm to give a toner concentration of 8% by weight, the carrier being ferrite particles covered with a styrene-acryl resin. Thus, color developers 1 through 17 of each color were prepared.

<<Evaluation>>

As an image formation apparatus for evaluation was provided one in which a commercially available digital printer, "bizhub Pro C500 (produced by Konica Business Technologies, Inc.)" was equipped with a patch image detective sensor as shown in FIG. 4 and a cleaning means for cleaning a secondary transfer member as shown in FIG. 7*a*.

The toners and the developers prepared as above were placed in that order into the image formation apparatus above. Then, a letter image with an image area ratio of 10% was printed on 400,000 A4 wood-free paper sheets at 20° C. and 50% RH. A patch image of each of four colors was printed every 1000 sheets, which was a solid 15×15 mm image. The patch image toner was set to be transferred from the intermediate transfer member to the secondary transfer member.

<Cleaning Performance>

After printing 400,000 sheets, the letter image with an image area ratio of 10% and the patch image were printed at 20° C. and at 50% RH and then toner cleaning was carried out through the cleaning blade, the surface of the photoreceptor, of the intermediate transfer member, and of the secondary transfer member was visually observed and any residual toner and any patch image toner remaining on the surface thereof was used to evaluate cleaning performance according to the following evaluation criteria.

Evaluation Criteria

A: No cleaning defects were found on the surface of the photoreceptor, the intermediate transfer member, or the secondary transfer member, which was rated to be "good".

B: Slight cleaning defects were found on the surface of the photoreceptor, the intermediate transfer member, or the secondary transfer member, which was rate not problematic in practice.

C: Many cleaning defects were found on the surface of the photoreceptor, the intermediate transfer member, or the secondary transfer member, which was rated problematic in practice.

<Fog>

After printing 400,000 sheets, a letter image with an image area ratio of 10% and a patch image were printed at 20° C. and 50% RH. The density of fog at portions corresponding to the letter image parts and portions corresponding to the patch image parts and the density of white background of the sheet were measured, and the difference between fog density and white background density was evaluated as fog, resulting from faulty cleaning.

Regarding the white background density, densities at random 20 portions of an A4 paper sheet of A4 size were measured, and their averaged measurement was defined as the white background density. Regarding the fog density, densities at 4 portions of each of portions corresponding to the letter image parts and of portions corresponding to the patch image parts were measured, and the average of the measurements was defined as the fog density. The density was measured through a reflection densitometer RD-918 (Product of Macbeth Co., Ltd.). A fog of less than 0.006 at both portions corresponding to the letter image parts and portions corresponding to the patch image parts was acceptable.

<Image Density>

After printing 400,000 sheets, a solid black image was printed at 20° C. and at 50% RH. Densities at 12 portions of the printed solid black image were measured through a reflection densitometer RD-918 (Product of Macbeth Co., Ltd.), and evaluated. An image density of 1.35 or more is acceptable.

The above results are shown in Table 4.

TABLE 4

| | Toner No. of Each Color | Cleaning Performance | Fog | Image Density |
|---|---|---|---|---|
| Inv. Ex. 1 | 1 | A | 0.002 | 1.46 |
| Inv. Ex. 2 | 2 | A | 0.005 | 1.47 |
| Inv. Ex. 3 | 3 | B | 0.001 | 1.46 |
| Inv. Ex. 4 | 4 | A | 0.002 | 1.48 |
| Inv. Ex. 5 | 5 | B | 0.001 | 1.47 |
| Inv. Ex. 6 | 6 | B | 0.004 | 1.35 |
| Inv. Ex. 7 | 7 | B | 0.002 | 1.46 |
| Inv. Ex. 8 | 15 | B | 0.001 | 1.45 |
| Inv. Ex. 9 | 16 | B | 0.001 | 1.46 |
| Inv. Ex. 10 | 17 | A | 0.002 | 1.46 |
| Comp. Ex. 1 | 8 | B | 0.009 | 1.27 |
| Comp. Ex. 2 | 9 | C | 0.001 | 1.45 |
| Comp. Ex. 3 | 10 | A | 0.011 | 1.46 |
| Comp. Ex. 4 | 11 | C | 0.003 | 1.47 |
| Comp. Ex. 5 | 12 | C | 0.002 | 1.46 |
| Comp. Ex. 6 | 13 | C | 0.008 | 1.45 |
| Comp. Ex. 7 | 14 | C | 0.001 | 1.46 |

Inv. Ex. Inventive Example,
Comp. Ex. Comparative Example

As is apparent from Table 4, Inventive Examples 1 through 10 have no problems in any of the evaluation items above, while Comparative Examples 1 through 7 have problems in any of the evaluation items above, and do not attain the object of the invention.

What is claimed is:

1. Toner, which is used in an image formation process comprising the steps of transferring an image of toner formed on a photoreceptor onto a recording sheet, and removing any residual toner remaining on any of the photoreceptor, an intermediate transfer member and a secondary transfer member with a cleaning blade, the toner containing at least toner particles (A) and small particles (B), wherein the toner particles (A) have an average circularity of from 0.93 to 0.99 and a number-based median diameter ($D_{50}$) of from 3.0 to 8.0 μm, the small particles (B) have an average circularity of from 0.70 to 0.92 and a number-based median diameter ($D_{50}$) of from 0.15 to 0.60 times that of the toner particles (A), and the surface energy of the toner particles (A) is different from that of the small particles (B).

2. The toner of claim 1, wherein the content of the small particles (B) is 0.2 to 20 parts by weight, based on 100 parts by weight of the toner particles (A).

3. The toner of claim 2, wherein the surface energy of the toner particles (A) is greater than that of the small particles (B).

4. The toner of claim 1, wherein the absolute value of the difference between the surface energy of the toner particles (A) and that of the small particles (B) is not less than $3\times10^{-3}$ N/m.

5. The toner of claim 4, wherein the surface energy of the toner particles (A) is greater than that of the small particles (B).

6. The toner of claim 1, wherein the surface energy of the toner particles (A) is greater than that of the small particles (B).

* * * * *